US006396895B1

(12) United States Patent
Hänsch

(10) Patent No.: US 6,396,895 B1
(45) Date of Patent: May 28, 2002

(54) VERIFYING DEVICE

(75) Inventor: Egon Hänsch, Wetzikon (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/454,463

(22) Filed: Dec. 3, 1999

(30) Foreign Application Priority Data

Jan. 5, 1999 (CH) ..... 0006/99

(51) Int. Cl.[7] ..... G06M 7/00
(52) U.S. Cl. ..... 377/8; 271/265.01
(58) Field of Search ..... 377/8; 198/502.1, 198/958; 271/265.01, 149, 216, 258.01

(56) References Cited

U.S. PATENT DOCUMENTS 3,684,845 A 8/1972 Palmer ..... 200/61.41
4,139,765 A * 2/1979 Pomey ..... 377/8
4,539,470 A * 9/1985 Honegger et al. ..... 377/8
4,562,339 A 12/1985 Sjogren et al. ..... 235/98
4,713,831 A 12/1987 Morisod ..... 377/8
5,084,906 A 1/1992 Reist ..... 377/8

FOREIGN PATENT DOCUMENTS

WO PCT/CH98/00558 12/1998
WO PCT/CH98/00559 12/1998
WO PCT/CH98/00560 12/1998

* cited by examiner

*Primary Examiner*—Tuan T. Lam
(74) *Attorney, Agent, or Firm*—Brinks Hofer Gilson & Lione

(57) ABSTRACT

The invention concerns a device for verifying, in particular for counting, preferably sheet-like articles (10), in particular printing products, having at least one feeler (20) which can be acted on by articles (10) moving in relation to the feeler (20) in a verification region and can be moved from a stable feeling position into a stable evaluating position, a sensor (30) for generating a verification signal when the feeler (20) is in the evaluating position and a returning member (60, 95) for returning the feeler (20) into the feeling position.

17 Claims, 3 Drawing Sheets

VERIFYING DEVICE

BACKGROUND OF THE INVENTION

The invention concerns a device for verifying, in particular for counting, preferably sheet-like articles, in particular printing products.

In the production of printing products, such as newspapers or periodicals for example, they are transported, for example, either lying individually or in the form of an imbricated stream on a conveyor belt, or respectively placed individually over saddles, from one processing station to the next. In this case, the number of products must be known as accurately as possible.

EP-A-0 408 490 discloses a device for counting printing products in which a contact element, which is arranged underneath an imbricated stream, is brought into contact with the trailing edge of a printing product. On contact with the trailing edge, a signal is emitted from a detector element, interacting with the contact element, to a counter.

BRIEF SUMMARY OF THE INVENTION

The object of the invention is to provide a device of the type stated at the beginning which, while of as simple a construction as possible, permits reliable verification of the respective articles.

The solution achieving this object is provided by the provision of at least one feeler which can be acted on by articles moving in relation to the feeler in a verification region and can be moved from a stable feeling position into a stable evaluating position, a sensor for generating a verification signal when the feeler is in the evaluating position, and also a returning member for returning the feeler into the feeling position.

According to the invention, a bistable mechanical store is provided with which two different items of information can be stored, namely "article present" or "article not present." These two discrete states of the feeler are distinguished by the sensor, which is consequently able to read out the stored information. By means of the returning member, the feeler is, as it were, "re-armed," i.e. transferred into its feeling position in which it can be acted on mechanically by an article to be verified. The feeler, according to the invention, may also be referred to as a toggle switch, which can be switched over by an article to be verified, or by the returning member, from one stable position via a dead center into the other stable position.

The device, according to the invention, is suitable, in particular, for counting printing products which are being transported, for example, lying in an imbricated stream on a conveyor belt. For this purpose, the device is brought up to the imbricated stream in such a way that the feeler or a contact element firmly connected to the feeler is located in a verification region lying in the path of movement of the printing products and is acted on by the leading or trailing edge of the moving product, for example a newspaper or periodical, and moved into the evaluating position. While the sensor generates a verification signal serving as a counting pulse, when the feeler is in the evaluating position, a counter connected to the sensor is not activated in the case of a missing product. Consequently, with appropriate coordination between on the one hand the expected setpoint time which elapses between the crossing of the verification region by two successive products and on the other hand the time which elapses from when the feeler is acted on until the point in time at which it is back in the feeling position in the verification region, all the products moved in relation to the verifying device can be counted or the absence of products actually expected can be detected.

Advantageous embodiments of the invention are specified in the dependent claims, the description and the drawings.

BRIEF DESCRIPTION OF SEVERAL VIEWS OF THE DRAWINGS

The invention is described below by way of example with reference to the drawings, in which.

DETAILED DESCRIPTION OF THE INVENTION

Figure 1A:
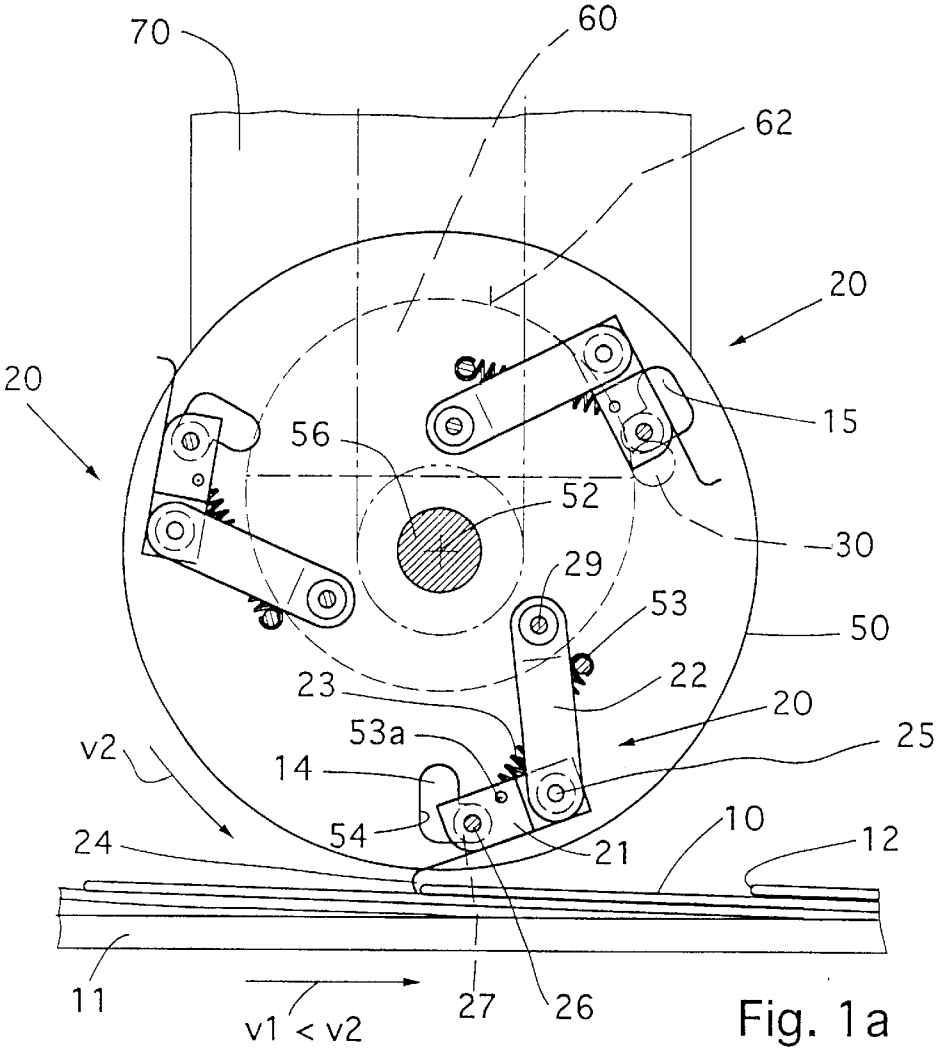
FIG. 1*a* shows a side view of a verifying device having a plurality of feelers moving on a circular path for counting printing products according to one embodiment of the invention.

The device according to the invention represented in FIGS. 1*a* and 1*b* serves in the arrangement represented for counting sheet-like printing products, for example newspapers or periodicals, which are referred to in the following as articles 10. The articles 10 are arranged in an imbricated formation on a conveyor belt 11, which moves the articles 10 to the right in FIG. 1*a* at a speed $v_1$. In the imbricated formation, each article 10 rests on the article respectively following, seen in the conveying direction, the trailing edges 12 of the articles 10 lying exposed in the upward direction.

Arranged above the imbricated stream formed by the articles 10 is a drum 50, explained in more detail below, of the verifying or counting device according to the invention, which drum is fitted on a frame 70 which is stationary at least during counting operation, and comprises three feelers 20. Each feeler 20 has two levers 21, 22, which are connected to each other in a jointed manner and can be pivoted with respect to each other about an axis 25, the one lever 22 being articulated by its free end onto the drum 50 in such a way that it can be pivoted about an axis 29. The free end of the other lever 21 is guided in an L-shaped clearance 54 formed in the drum 50. Provided for this purpose are guide rings 27, which are carried by a connecting element 26 and the diameter of which corresponds to the width of the L-shaped clearance 54. Firmly connected to the lever 21 of the feeler 20 guided in the clearance 54 is a feeling finger or contact element 24, which protrudes by its free end, bent in a hook-like manner, into the path of movement of the conveyed articles 10.

The drum 50 is connected in a rotationally fixed manner to a drive shaft 56, by means of which the drum 50 can be rotated uniformly or intermittently about an axis of rotation 52. In FIG. 1*a*, the device, according to the invention, is shown in a snapshot in which the lower feeler 20 is in a verification region in which the contact element 24 is in the process of engaging with the trailing edge 12 of the article 10 lying under the feeler 20. The rotation of the drum 50 takes place in such a way that the speed $v_2$ of the contact element 24 in the verification region is greater than the speed $v_1$ of the conveyed articles 10, the contact element 24 and the articles 10 moving in the same direction. As a result, a relative movement takes place between the contact element 24 of the feeler 20 and the article 10, respectively, in the verification region so that the contact element 24 is acted on by the trailing edge 12 of the article 10.

The L-shaped clearance for the lever 21 carrying the contact element 24 of the feeler 20 is aligned in such a way that, when the contact element 24 is in the verification region, one portion 15 (compare the feeler 20 at the top right) runs approximately parallel to the direction of movement of the articles 10 and a further portion 14 extends perpendicular thereto toward the axis of rotation 52 of the drum 50.

By means of a tension spring 23, which is restrained between a pin 53, fixed to the drum, and a pin 53*a*, connected to the lever 21 guided in the clearance 54, the feeler 20 is prestressed in such a way that it is held stable either in a feeling position or an evaluating position. The lower feeler 20 in FIG. 1*a* is in the feeling position in which the guide ring 27 bears against the free end of the portion 15 of the clearance 54 extending parallel to the direction of the articles 10. The feeler 20, represented at the top right in FIG. 1*a*, on the other hand, is in the evaluating position in which the guide ring 27 bears against the free end of the other portion 14 of the clearance 54.

There may also be greater or fewer than three feelers 20 provided, it being preferred in the case of a number of feelers 20 for these to be arranged evenly distributed on a circle. In principle, operation with only one feeler moving, for example, on a circular path, is also possible.

The switching over between these two discrete stable states of the feelers 20 takes place in the one direction by the articles 10 and in the other direction by a returning member. Provided as the returning member is a disk 60, which is arranged eccentrically with respect to the drum 50 and fixed in place. The disk 60 forms a guideway, the edge 62 of the disk 60 serving as a control cam along which the feeler 20 is moved by the free end of its lever 21, guided in the clearance 54, once the feeler 20 has left the verification region.

Figure 1B:
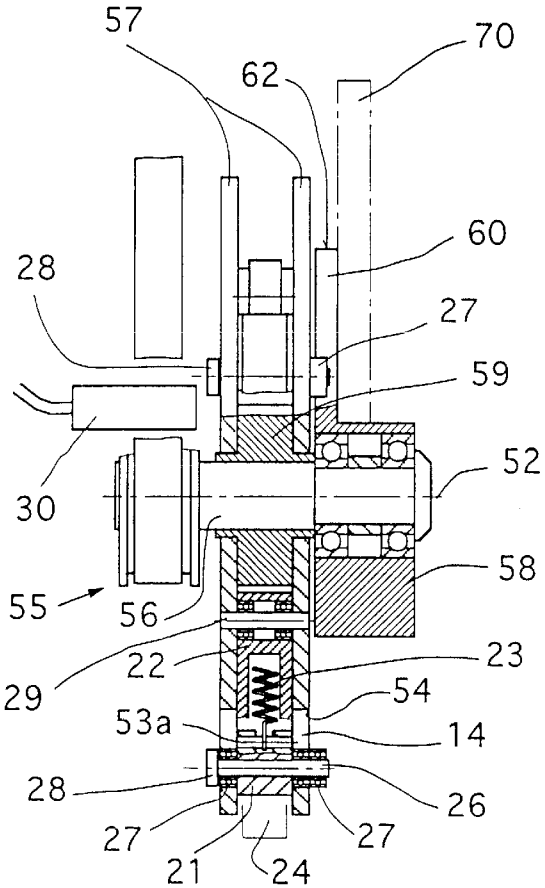
FIG. 1*b* shows a partially sectioned view of the device from FIG. 1*a* in a view turned through 90° with respect to FIG. 1*a;*

The arrangement of the disk 60 and of a fixed-in-place sensor 30, which detects the presence of the feeler 20 in the evaluating position and emits a corresponding signal, can be seen more clearly from FIG. 1*b*.

FIG. 1*b* reveals that the drum 50 comprises two plane-parallel disks 57 between which the levers 21, 22 of the feelers 20 are arranged. The connecting element 26 carrying the guide rings 27 of the lever 21 guided in the clearance 54 can be seen. FIG. 1*b* also shows a pin 53*a* for the tension spring 23 and also the bearing pin 29, by means of which the lever 22 of the feeler 20 is connected in a jointed manner to the two disks 57 of the drum 50.

The drive shaft 56, coupled on one side of the drum 50 to a drive unit 55 and rotatably mounted on the other side in a bearing block 58, carries a driver 59 to which the two disks 57 are connected in a rotationally fixed manner and which also serves as a spacing element for the disks 57. The disk 60, serving as the returning member, is designed as an integral component of the bearing block 58. The edge 62 of the disk 60 interacts with a guide ring 27, arranged on the outer side of the right-hand plate 57 in FIG. 1*b*, of the connecting element 26 of the lever 21 guided in the clearance 54, which is explained in more detail below.

The head of the connecting element 26, which is arranged on the outer side of the other, left-hand plate 57 in FIG. 1*b*, serves as a verifying portion 28 of the feeler 20 which interacts with the sensor 30. FIG. 1*b* shows that, according to the invention, the sensor 30 is not connected to the rotating drum 50 and, in principle, can be fixedly arranged in place at any desired point in the path of movement of the evaluating position upstream of the returning member.

For verifying or counting the moving articles 10 the device, according to the invention, is moved into the position represented in FIG. 1*a* and rotated at the speed $v_2$ mentioned above, which is greater than the speed $v_1$ of the articles 10. The movements of the drum 50 and of the articles 10 are coordinated with one another in such a way that the trailing edge 12 of an article 10 and the contact element 24 are in each case in the verification region at the same point in time. On account of the higher speed of the drum 50, the trailing edge 12 is, as it were, overtaken by the contact element 24 in the verification region so that the contact element 24 is stopped by the trailing edge 12—viewed from the drum 50—whereby the lever 21 is moved out of its end position in the portion 15 of the clearance 54. As this happens, the tension spring 23 is deflected and pulls the lever 21, after reaching the dead center in the clearance 54, into the other portion 14 of the clearance 54, extending radially toward the axis of rotation 52. This snapping over of the lever 21 from the feeling position into the evaluating position is made possible by the ability of the two levers 21, 22 to pivot about the axis 25.

Shown at the top right in FIG. 1*a* is a feeler 20 which is moved in this way by an article 10 from the stable feeling position into the stable evaluating position and the lever 21 of which, guided in the clearance 54, runs perpendicular to the other lever 22. This state is detected by the sensor 30 because, when the verifying portion 28 of the connecting element 26 of the lever 21 moves past, the two circular surfaces of the verifying portion 28 and of the sensor overlap to a maximum extent, at least for a short time. In the case of a sensor 30 designed as an induction switch, the voltage induced when the verifying portion 28 moves past can be used to generate a corresponding verification signal, which is fed to a counting unit (not shown) which interprets the verification signal as a counting pulse. The sensitivity of the sensor 30 is set in such a way that, in its feeling position, a feeler 20 would not generate a signal or only a signal below an adjustable verification threshold when it moves past the sensor 30.

The device, according to the invention, is, furthermore, designed in such a way, dependent on the expected interval between two successive articles 10 on the conveyor belt 11, that a feeler 20 is always moved into the verification region whenever an article 10 to be counted, or its trailing edge 12 to be brought into engagement with the contact element 24, is expected in the verification region.

Serving for switching the feelers 20 back again into the feeling position is the disk 60, which is arranged eccentrically with respect to the drum 50 and along the edge 62 of which, forming a guideway, the guide rings 27 of the connecting elements 26 are guided, provided that the feeler 20 has first been adjusted into the evaluating position. By means of the guide ring 27, the lever 21 is pressed by the disk edge 62 in the direction of the dead center of the path defined by the L-shaped clearance 54, while the feeler 20 is moved around the disk 60. After reaching the dead center, the tension spring 23 pulls the feeler 20 into the free end of the approximately tangentially running portion 15 of the clearance 54. When the feeler 20, returned in this way, is subsequently moved back again into the verification region, it can be transferred again by a possibly present article 10 or its trailing edge 12 into the evaluating position in order then, in turn, to transport the information "article present" to the sensor 30.

Figure 2:
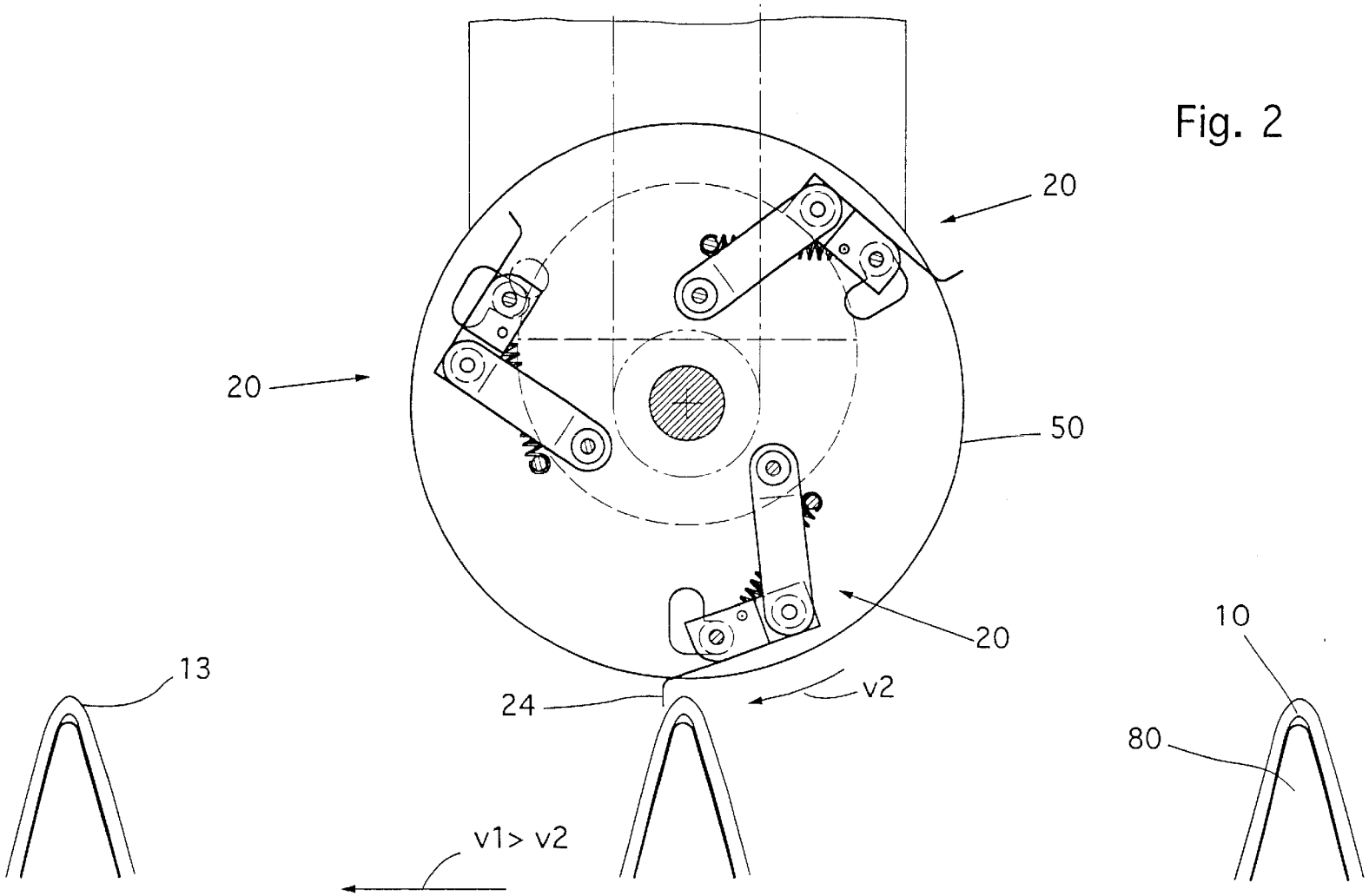
FIG. 2 shows another application of the verifying device from FIG. 1*a*.

FIG. 2 shows another application of the verifying or counting device according to the invention from FIGS. 1*a* and 1*b*. According to FIG. 2, the counting device serves for counting printing products or articles 10, respectively, lying individually on a saddle 80, which are moved at a speed $v_1$ to the left in FIG. 2 past the counting device. The saddles 80 may be arranged on a drum and be rotated past the verifying device according to the invention.

The drum 50 is rotated in such a way that, in the verification region, the contact elements 24 are moved in the direction of the moving articles 10 at a speed $v_2$ which is less than the speed $v_1$ of the articles 10. As a result, the counting device, according to the invention, is designed to interact with the leading edges 13 of the articles 10 which overtake the contact element 24 in the verification region on account of their higher speed.

In both embodiments explained above, the feelers 20 are, as shown, moved uniformly or else intermittently on their circular path in each case in such a way that, whenever a position at which the presence of an article 10 to be counted is expected on the respective conveyor passes the verification region, a feeler 20, which is in the sensing position and can consequently be acted on by means of the article 10, is located in the verification region.

Figure 3A:
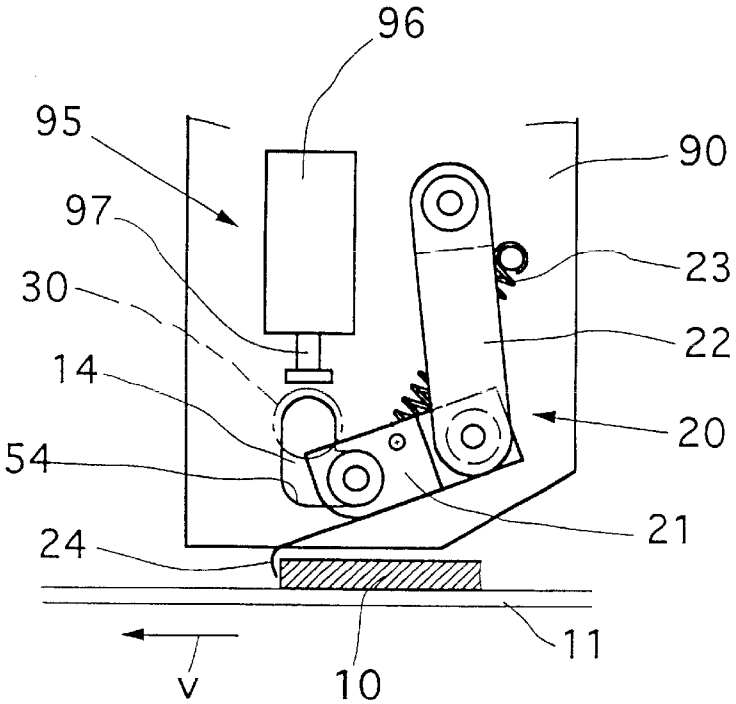
FIGS. 3*a* and 3*b* show schematic side views of a verifying device according to a further embodiment of the invention, with the feeler in the feeling position and in the evaluating position, respectively.
Figure 3B:
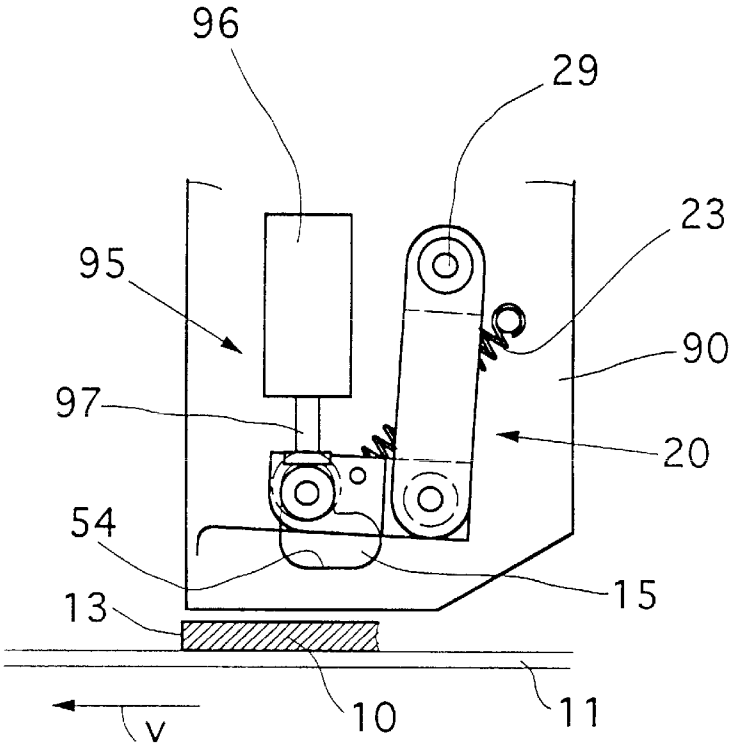

FIGS. 3*a* and 3*b* show another embodiment of a verifying or counting device according to the invention, in which the single feeler 20, mounted on a fixed-in-place frame 90, is not subjected to any independent movement, apart from the switching movement between the sensing position and the evaluating position. A number of individual feelers 20 may also be arranged one behind the other along the conveyor belt 11.

As FIG. 3*a* reveals, the contact element 24 is acted on by the leading edge 13 of a single article 10, for example a printing product, lying on the conveyor belt 11 and moving at a speed v to the left in FIG. 3*a*, and is transferred into the evaluating position shown in FIG. 3*b*. Instead of single spaced-apart articles 10, an imbricated stream of articles 10 may also be guided past the counting device, as is shown in FIG. 1*a*.

The presence of the feeler 20 in the evaluating position is, in turn, verified, for example inductively by means of a sensor 30, and passed on to a counter (not shown).

The variant of FIGS. 3*a* and 3*b* also differs from the embodiments of the invention mentioned above by the design of the returning member, which is designed as a piston/cylinder unit 95. A piston 97 guided and operated, for example hydraulically or pneumatically, in a cylinder 96 is extended for returning the lever 21.

Operation of the device according to FIGS. 3*a* and 3*b*, takes place intermittently according to the time period which elapses between the passing of two successive articles 10 or expected setpoint positions of articles 10 on the conveyor belt 11 through the verification region. In this case, the piston/cylinder unit 95 may interact with the sensor 30 in such a way that a returning movement of the piston 97 takes place only when the sensor 30 detects the presence of the feeler 20 in the evaluating position. The sensor 30 consequently serves here as an initiator for the returning member 95.

In the embodiments of the invention described above, the verifying or counting device consequently serves as a mechanical store with one or more feelers 20, respectively serving as a unitary storage cell, it being possible for the informational content transported by the feelers 20 or stored in the feelers 20 to be read off, and a distinction being made between two discrete, mechanically stable positions of the respective feeler 20.

The invention consequently not only allows it to be established whether or not an article is present in the verification region, but also allows the number of articles moved through the verification region to be determined.

What is claimed is:

1. A device for verifying, in particular for counting, preferably sheet-like articles (10), in particular printing products, having at least one feeler (20), which is acted on by articles (10) moving in relation to the feeler (20) in a verification region and is moved from a stable feeling position into a stable evaluating position, a sensor (30) for generating a verification signal when the feeler (20) is in the evaluating position, and a returning member (60; 95) for returning the feeler (20) into the feeling position.

2. A device for verifying, in particular for counting, preferably sheet-like articles (10), in particular printing products, having at least one feeler (20), which is acted on by articles (10) moving in relation to the feeler (20) in a verification region and is moved from a stable feeling position into a stable evaluating position, said feeler (20) being movable between the feeling position and the evaluating position along a path which comprises a first portion (15), adjoining the feeling position and extending at least approximately parallel to the direction of movement of the articles (10) in the verification region, and also a second portion (14), running oblique or perpendicular to the first portion (15), a sensor (30) for generating a verification signal when the feeler (20) is in the evaluating position, and a returning member (60; 95) for returning the feeler (20) into the feeling position.

3. A device for verifying, in particular for counting, preferably sheet-like articles (10), in particular printing products, having at least one feeler (20), which is acted on by articles (10) moving in relation to the feeler (20) in a verification region and is moved from a stable feeling position into a stable evaluating position, said feeler (20) being respectively prestressed into the feeling position and into the evaluating position and is held in the respective position by a flexible element, preferably a tension spring (23), a sensor (30) for generating a verification signal when the feeler (20) is in the evaluating position, and a returning member (60; 95) for returning the feeler (20) into the feeling position.

4. A device for verifying, in particular for counting, preferably sheet-like articles (10), in particular printing products, having at least one feeler (20), which is acted on by articles (10) moving in relation to the feeler (20) in a verification region and is moved from a stable feeling position into a stable evaluating position, said feeler (20) being movable between the feeling position and the evaluating position along a path which comprises a first portion (15), adjoining the feeling position and extending at least approximately parallel to the direction of movement of the articles (10) in the verification region, and also a second portion (14), running oblique or perpendicular to the first portion (15), said feeler (20) being respectively prestressed into the feeling position and into the evaluating position and is held in the respective position in particular by means of a flexible element, preferably a tension spring (23), a sensor (30) for generating a verification signal when the feeler (20) is in the evaluating position, and a returning member (60; 95) for returning the feeler (20) into the feeling position.

5. The device as claimed in one of claims 1 or 2 or 3 or 4, wherein the feeler (20) comprises at least two levers (21, 22) which are connected to each other in a jointed manner, the one lever (21) being guided by its free end between the feeling position and the evaluating position along a path and the other lever (22) being articulated with its free end fixed in place.

6. The device as claimed in one of claims 1 or 2 or 3 or 4, wherein the sensor (30) is arranged fixed in place and wherein the sensor (30), in particular its verification signal, serves as an initiator for the returning member (60, 95).

7. The device as claimed in one of claims 1 or 2 or 3 or 4, wherein the feeler (20) is moved uniformly or intermittently through the verification region and in particular on a circular path, the feeler (20) preferably being fitted on a rotatably driveable, in particular disk-like or drum-like component (50), the axis of rotation (52) of which runs approximately perpendicular to the direction of movement of the articles (10) in the verification region.

8. The device as claimed in claim 7, wherein, at least in the verification region, the feeler (20) is moved in the direction of the articles (10) and either faster or slower than the articles (10).

9. The device as claimed in claim 7, wherein a number of feelers (20) are moved one after the other and preferably repeatedly through the verification region, the feelers (20) preferably being arranged evenly distributed on a circular path.

10. The device as claimed in claim 8, wherein a number of feelers (20) are moved one after the other and preferably repeatedly through the verification region, the feelers (20) preferably being arranged evenly distributed on a circular path.

11. The device as claimed in claim 7, wherein a guideway (62), along which the feeler (20) is moved outside the verification region, is provided as the returning member, the edge of a component (60), in particular a disk-shaped component, which is arranged eccentrically with respect to said circular path of the feeler (20), preferably being provided as the guideway (62).

12. The device as claimed in claim 8, wherein a guideway (62), along which the feeler (20) is moved outside the verification region, is provided as the returning member, the edge of a component (60), in particular a disk-shaped component, which is arranged eccentrically with respect to said circular path of the feeler (20), preferably being provided as the guideway (62).

13. The device as claimed in claim 9, wherein a guideway (62), along which the feeler (20) is moved outside the verification region, is provided as the returning member, the edge of a component (60), in particular a disk-shaped component, which is arranged eccentrically with respect to said circular path of the feeler (20), preferably being provided as the guideway (62).

14. The device as claimed in claim 10, wherein a guideway (62), along which the feeler (20) is moved outside the verification region, is provided as the returning member, the edge of a component (60), in particular a disk-shaped component, which is arranged eccentrically with respect to said circular path of the feeler (20), preferably being provided as the guideway (62).

15. The device as claimed in one of claims 1 or 2 or 3 or 4, wherein the feeler (20) is arranged fixed in place with respect to the verification region.

16. The device as claimed in claim 5, wherein the feeler (20) is arranged fixed in place with respect to the verification region.

17. The device as claimed in claim 6, wherein the feeler (20) is arranged fixed in place with respect to the verification region.

* * * * *